US005839543A

United States Patent [19]

Chiu

[11] Patent Number: 5,839,543

[45] Date of Patent: Nov. 24, 1998

[54] ELEVATOR DOOR CONTROL MECHANISM

[76] Inventor: Tai Tien Chiu, P.O. Box 63-99, Taichung, Taiwan

[21] Appl. No.: 796,996

[22] Filed: Feb. 7, 1997

[51] Int. Cl.[6] ..... B66B 13/06

[52] U.S. Cl. ..... 187/324; 187/334; 49/360; 49/125

[58] Field of Search ..... 187/318, 324, 187/334; 49/360, 125, 127

[56] References Cited

U.S. PATENT DOCUMENTS

| | | | |
|---|---|---|---|
| 1,269,927 | 3/1918 | Groat | 187/318 |
| 2,077,659 | 4/1937 | Bancroft | 187/318 |
| 2,303,236 | 11/1942 | Fisher | 49/360 |
| 2,328,326 | 8/1943 | Byrne | 49/125 |
| 3,577,679 | 5/1971 | Petterborg | 49/127 |
| 3,707,205 | 12/1972 | Gibson | 187/324 |
| 4,149,615 | 4/1979 | Kappenhagen | 49/360 |
| 4,852,300 | 8/1989 | Keast | 49/125 |
| 5,317,934 | 6/1994 | Zannis | 187/324 |
| 5,377,448 | 1/1995 | Boyd et al. | 49/360 |
| 5,711,112 | 1/1998 | Barten et al. | 49/360 |

*Primary Examiner*—William E. Terrell
*Assistant Examiner*—Khoi H. Tran

[57] ABSTRACT

An elevator includes a housing having three door panels and a lever swung to operate the door panels. A casing is secured on top of the housing and has three tracks for slidably receiving three slides which are secured to the door panels. A wire couples two of the slides to the casing for guiding the slides to move relative to the tracks, and another wire couples the other slide and the middle slide for guiding the other slide to move relative to the middle slide and for allowing the door panels to be moved safely and smoothly.

2 Claims, 4 Drawing Sheets

ELEVATOR DOOR CONTROL MECHANISM

BACKGROUND OF THE INVENTION

1. Field of the Invention

The present invention relates to a control mechanism, and more particularly to a control mechanism for an elevator door.

2. Description of the Prior Art

Typical elevators comprise two, three or more door panels for different use. For typical elevators having three door panels, the control mechanism includes a huge volume and dangerous and may hurt the user.

The present invention has arisen to mitigate and/or obviate the afore-described disadvantages of the conventional three door elevator control mechanisms.

SUMMARY OF THE INVENTION

The primary objective of the present invention is to provide a control mechanism for safely and smoothly controlling the three door panels of the elevators.

In accordance with one aspect of the invention, there is provided an elevator comprising a housing including three door panels, a casing secured on top of the housing and including a board and three tracks, a lever pivotally secured to the casing at a pivot axle and including a first end secured to a first of the door panels for moving the door panels, means for swinging the lever and for moving the door panels, three slides slidably engaged on the tracks, a first of the slides being located close the board of the casing, a second of the slides being located between the first slide and a third of the slides, and means for coupling the slides together and for allowing the slides to be slided one relative to the other.

The coupling means includes a beam secured on top of the first slide and having two pulleys, a bar secured on top of the second slide and having two pulleys, a first wire engaged on the pulleys of the first slide and coupled to the board and the second slide for guiding the second slide to move relative to the first slide and for guiding the first slide to move relative to the board, and a second wire engaged on the pulleys of the second slide and coupled to the beam and the third slide for guiding the third slide to move relative to the second slide.

The board includes a first bracket secured to the first wire, the second slide includes a second bracket secured to the first wire for guiding the first slide and the second slide to move relative to the board and relative to the first slide respectively, the beam includes a third bracket secured to the second wire and the third slide includes a fourth bracket secured to the second wire for guiding the third slide to move relative to the second slide.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
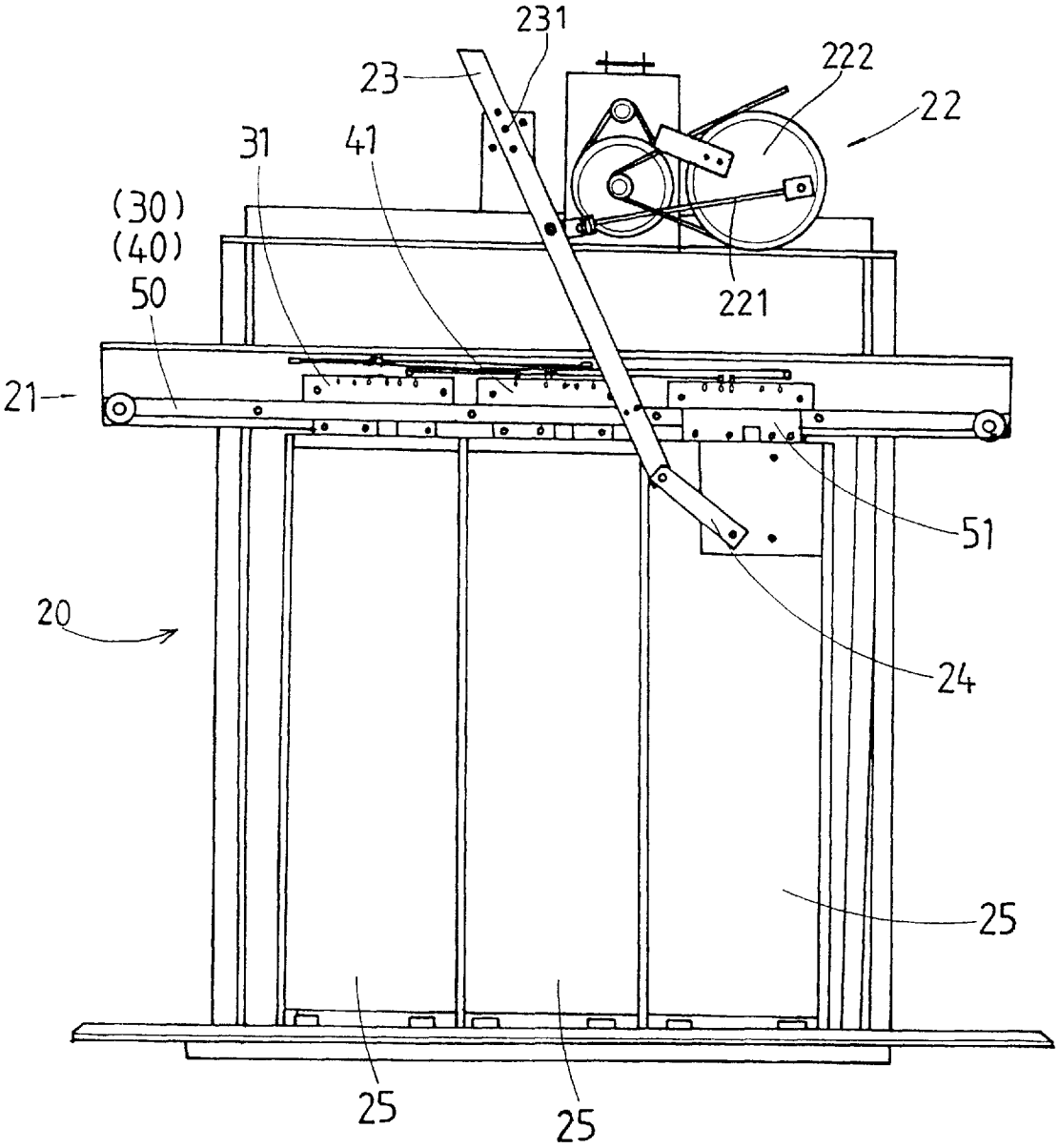
FIG. 1 is a front view of an elevator in accordance with the present invention.
Figure 2:
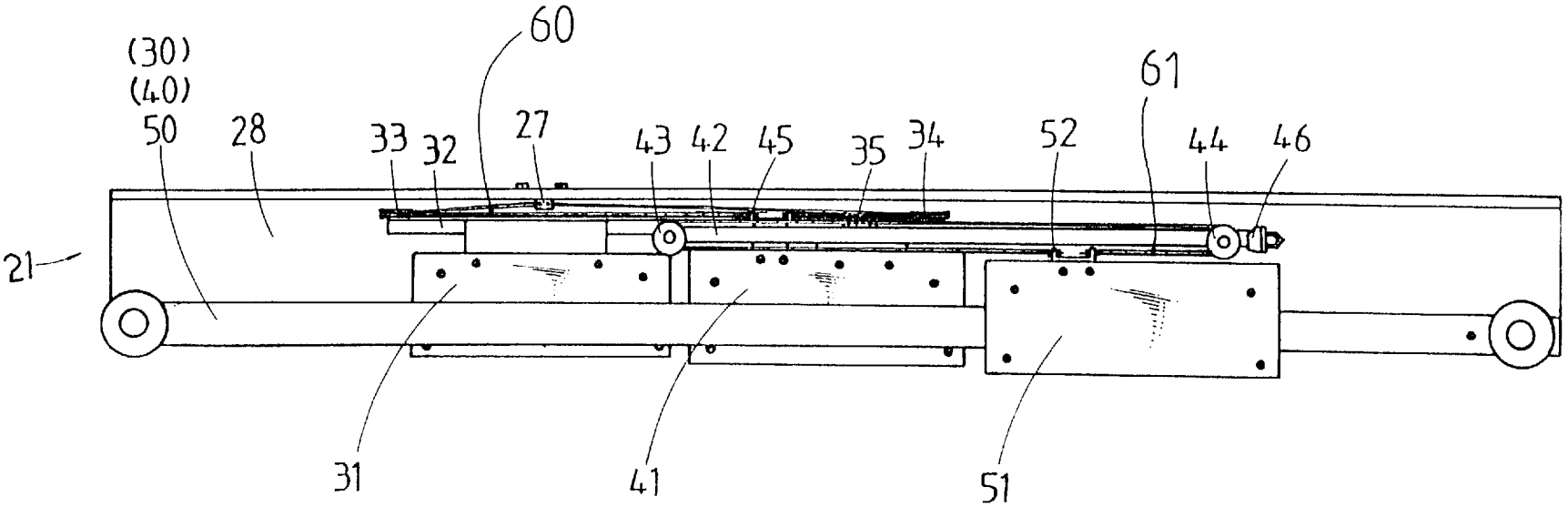
FIG. 2 is a front view of a control mechanism of the elevator.
Figure 3:
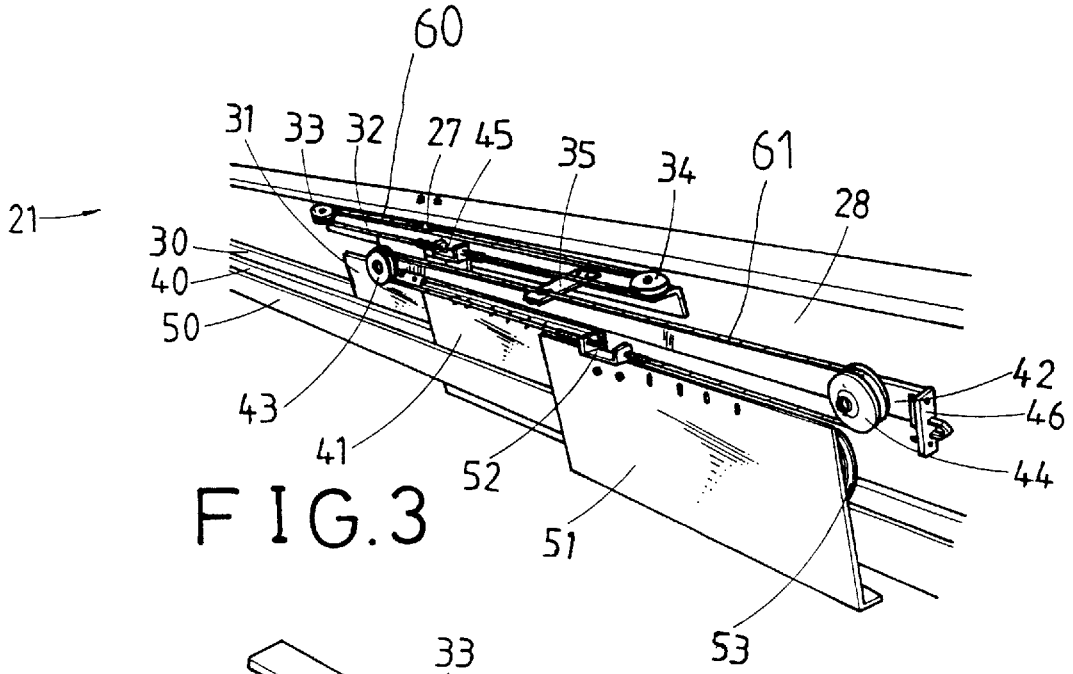
FIGS. 3 and 4 are perspective views illustrating the operation of the control mechanism.

Referring to the drawings, and initially to FIGS. 1 to 3, an elevator in accordance with the present invention comprises a housing 20 for carrying people and having three door panels 25, and a casing 21 secured on top of the housing 20. A lever 23 is pivotally secured to the casing 21 at a pivot axle 231 and includes an extension 24 pivotally coupled to one of the door panels 25. An actuating device 22 includes a link 221 pivotally coupled to the lever 23 and an eccentric wheel 222 coupled to the link 221 for swinging the lever 23 and for moving the door panels 25.

Figure 4:
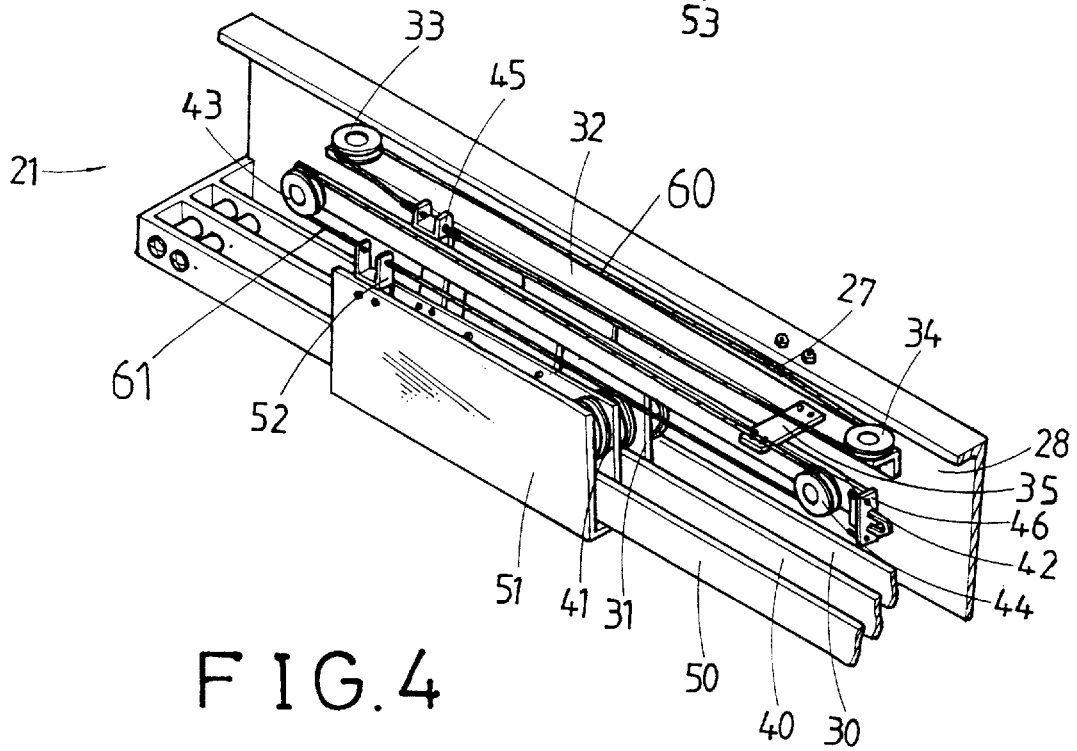
Figure 6:
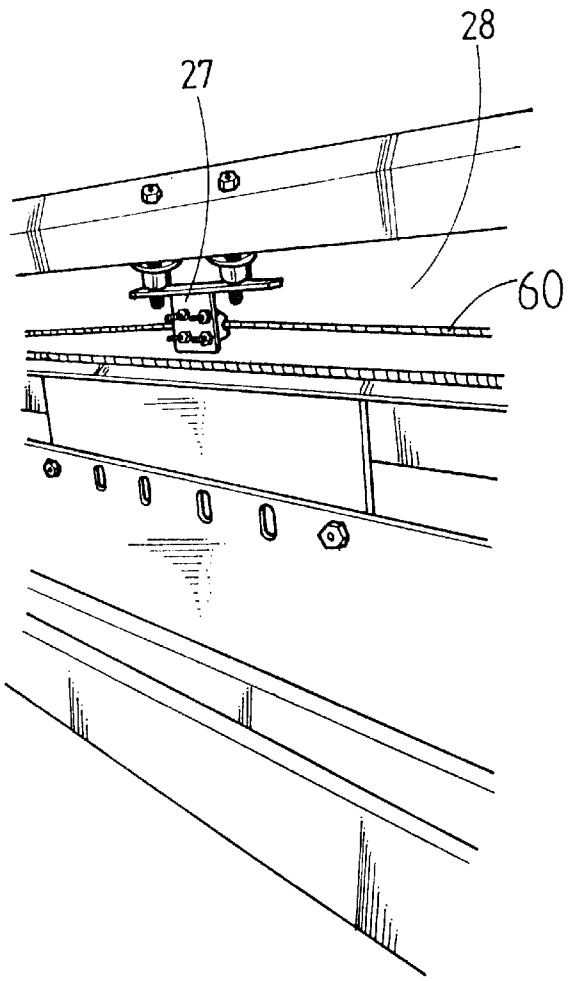
FIGS. 5 and 6 are partial perspective views illustrating the details of the control mechanism.
Figure 5:
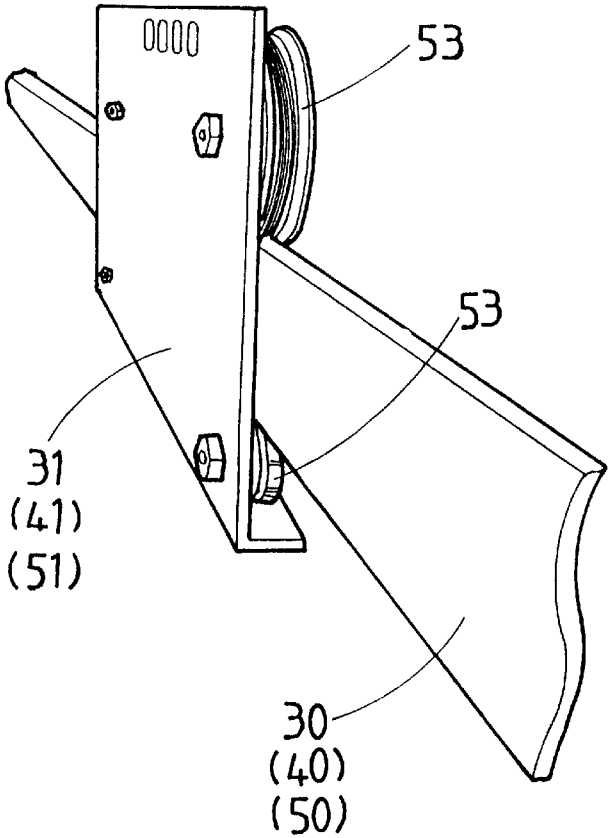

As best shown in FIGS. 2 to 4, the casing 21 includes a board 28 and three tracks 30, 40, 50 secured to the board 28. Three slides 31, 41, 51 are secured to the door panels 25 and each includes two wheels or rollers 53 (FIG. 5) for engaging with the tracks 30, 40, 50 and for allowing the slides 31, 41, 51 and the door panels 25 to be moved along the tracks 30, 40, 50 respectively. A beam 32 is secured on top of the slide 31 and includes two pulleys 33, 34 for engaging with a wire 60. The wire 60 is secured to the board 28 at a bracket 27 (FIG. 6) and has two ends secured to another bracket 45 which is secured on the slide 41 such that the slide 31 may be guided to move relative to the board 28 and the slide 41 may be guided to move relative to the slide 31. A bar 42 is secured on top of the slide 41 and includes two pulleys 43, 44 for engaging with a wire 61. The wire 61 is secured to the beam 32 at a bracket 35 (FIG. 6) and has two ends secured to another bracket 52 which is secured on the slide 51 such that the slide 51 may be guided to move relative to the slide 41. The bar 42 includes a stop 46 for engaging with a side wall of the elevator and for limiting the movement of the slides 31, 41, 51.

In operation, as shown in FIG. 1, when the lever 23 is swung about the pivot axle 231 by the actuating device 22, the door panels 25 may be moved laterally and may be guided to move along the tracks 30, 40, 50 smoothly by the slides 31, 41, 51.

Accordingly, the control mechanism in accordance with the present invention may safely and smoothly control the door panels of the elevator.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An elevator comprising:

a housing including three door panels, a casing secured on top of said housing and including a board and three tracks, a lever pivotally secured to said casing at a pivot axle and including a first end secured to a first of said door panels for moving said door panels, means for swinging said lever and for moving said door panels, three slides slidably engaged on said tracks, a first of said slides being located close to said board of said casing, a second of said slides being located between said first slide and a third of said slides, said door panels being coupled to said slides respectively for allowing said door panels to be moved in response to said slides respectively, and means for coupling said slides together and for allowing said slides to be slided one relative to the other, said coupling means including a beam secured on top of said first slide and having two pulleys, a bar secured on top of said second slide and having two pulleys, a first wire engaged on said pulleys of said first slide and coupled to said board and said second slide for guiding said second slide to move relative to said first side and for guiding said first slide to move relative to said board, and a second wire engaged on said pulleys of said second slide and coupled to said beam and said third slide for guiding said third slide to move relative to said second slide.

2. An elevator according to claim 1, wherein said board includes a first bracket secured to said first wire, said second slide includes a second bracket secured to said first wire for guiding said first slide and said second slide to move relative to said board and relative to said first slide respectively, said beam includes a third bracket secured to said second wire and said third slide includes a fourth bracket secured to said second wire for guiding said third slide to move relative to said second slide.

* * * * *